US007850287B2

(12) United States Patent
Iwao et al.

(10) Patent No.: US 7,850,287 B2
(45) Date of Patent: Dec. 14, 2010

(54) LIQUID EJECTION APPARATUS

(75) Inventors: Naoto Iwao, Nagoya (JP); Koji Kawai, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 512 days.

(21) Appl. No.: 11/864,680

(22) Filed: Sep. 28, 2007

(65) Prior Publication Data

US 2008/0309732 A1 Dec. 18, 2008

(30) Foreign Application Priority Data

Sep. 29, 2006 (JP) ..... 2006-269902

(51) Int. Cl.
*B41J 2/05* (2006.01)

(52) U.S. Cl. ..... 347/65; 347/68

(58) Field of Classification Search ..... 347/13, 347/42, 40, 43, 65–70

See application file for complete search history.

(56) References Cited

U.S. PATENT DOCUMENTS 6,244,688 B1 6/2001 Hickman
6,536,868 B1 3/2003 Kawamura et al.
6,557,989 B1 5/2003 Hirosawa et al.
2006/0125878 A1* 6/2006 Watanabe ..... 347/50
2006/0181579 A1 8/2006 Taira

FOREIGN PATENT DOCUMENTS

JP H09-286098 A 11/1997
JP 2001038894 A 2/2001
JP 2001-129977 A 5/2001
JP 2006-224318 A 8/2006

OTHER PUBLICATIONS

Japanese Patent Office, Notice of Reasons for Rejection in Japanese Patent Appl'n No. 2006-269902 (counterpart to the above-captioned patent application) mailed Oct. 7, 2008.

* cited by examiner

*Primary Examiner*—Lamson D Nguyen
(74) *Attorney, Agent, or Firm*—Baker Botts L.L.P.

(57) ABSTRACT

A liquid ejection apparatus having liquid ejection heads extending in a particular direction, and each liquid ejection head has an ejection surface with ejection ports configured to eject a liquid, a supply port to which liquid is supplied, and a flow path formed in the liquid ejection head. The flow path is configured to place the ejection ports and the supply port in fluid communication. The liquid ejection heads are positioned at predetermined intervals in a direction perpendicular to the particular direction, and for each liquid ejection head, the supply port of one liquid ejection head is in a different location in the particular direction, than all of the liquid ejection heads adjacent to the one liquid ejection head in the perpendicular direction.

15 Claims, 11 Drawing Sheets

LIQUID EJECTION APPARATUS

CROSS REFERENCE TO RELATED APPLICATION

This application claims priority to and the benefit of Japanese Patent Application No. 2006-269902, filed Sep. 29, 2006, the entire subject matter and disclosure of which is incorporated herein by reference.

BACKGROUND OF THE INVENTION

1. Field of the Invention

The invention relates to a liquid ejection apparatus having a plurality of liquid ejection heads arranged in a width direction of the apparatus.

2. Description of Related Art

A known liquid ejection apparatus, such as an inkjet printer, has a plurality of inkjet heads arranged in a width direction of the printer. For example, in a known inkjet printer, six heads, counting two heads as one in the longitudinal direction, are arranged in a width direction or x-axis direction. Each head is provided with fluid interconnections or supply ports, to which parts such as tubes are attached for supplying ink in the head, on both ends in a longitudinal direction. Thus, the supply ports of the heads are adjacently disposed in the width direction.

When the supply ports of the heads are adjacently disposed, working space is narrow and attaching parts such as tubes to the supply ports may be difficult. The parts are attached to the supply ports in narrow space, and thus connection failure may occur.

SUMMARY OF THE INVENTION

In an embodiment of the invention, a liquid ejection apparatus comprises a plurality of liquid ejection heads extending in a particular direction, each of the plurality of liquid ejection heads comprising an ejection surface comprising a plurality of ejection ports configured to eject a liquid, a supply port to which the liquid is supplied, and a flow path formed in the liquid ejection head. The flow path is configured to place the plurality of ejection ports and the supply port in fluid communication. The plurality of liquid ejection heads are positioned at predetermined intervals in a further direction, the further direction being substantially perpendicular to the particular direction, and wherein, for each of the plurality of liquid ejection heads, the supply port of one of the plurality of liquid ejection heads is positioned in a different location in the particular direction than all of the liquid ejection heads positioned adjacent to the one liquid ejection head in the further direction.

BRIEF DESCRIPTION OF THE DRAWINGS

Embodiments of the invention now are described with reference to the accompanying drawings, which are given by way of example only, and are not intended to limit the present invention.

DETAILED DESCRIPTION OF PREFERRED EMBODIMENTS

Preferred embodiments of the present invention, and their features and advantages, may be understood by referring to accompanying drawings, like numerals being used for corresponding parts in the various drawings.

Figure 1:
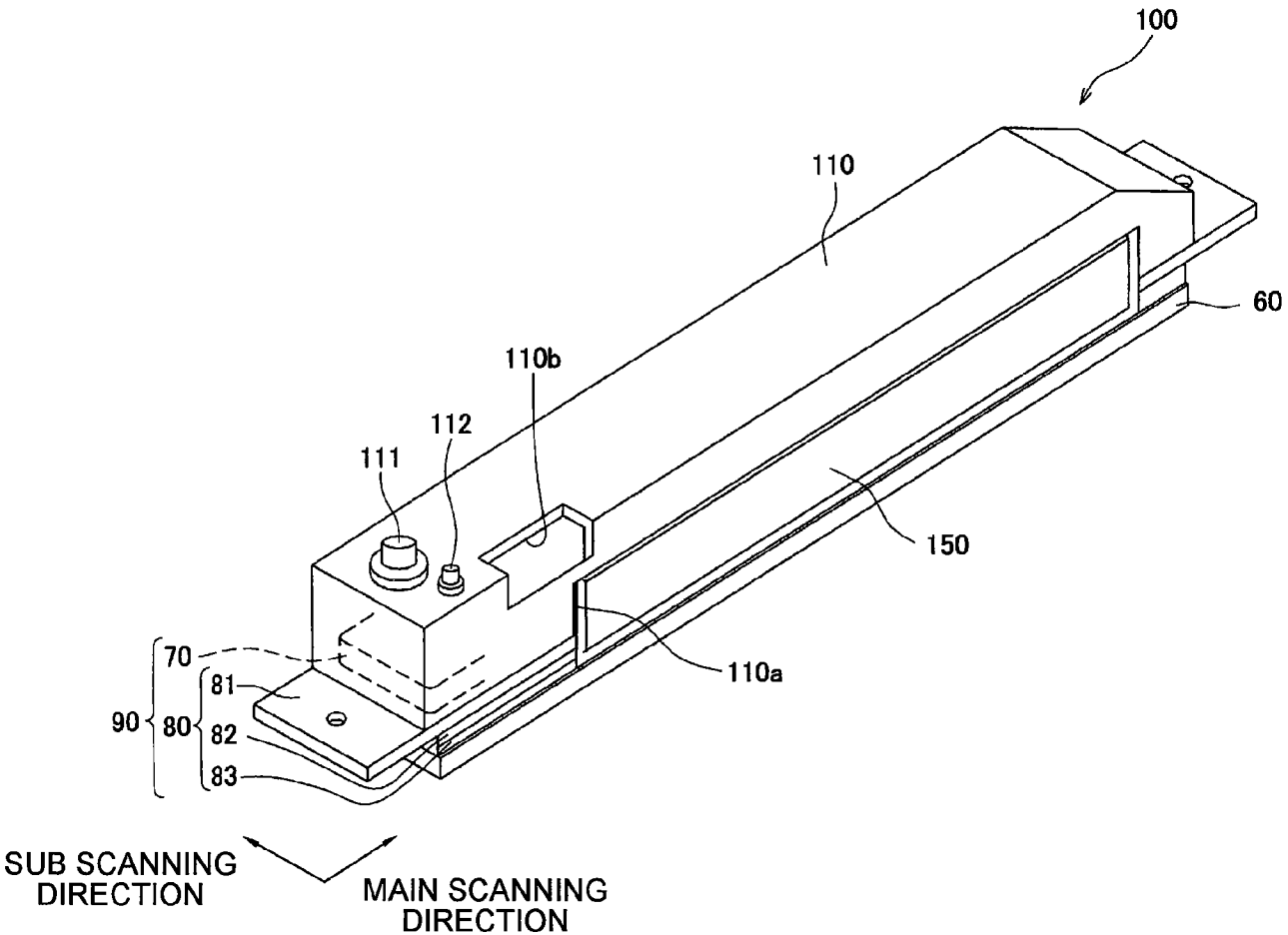
FIG. 1 is a perspective view of a liquid ejection head included in an inkjet printer according to an embodiment of the invention.
Figure 2:
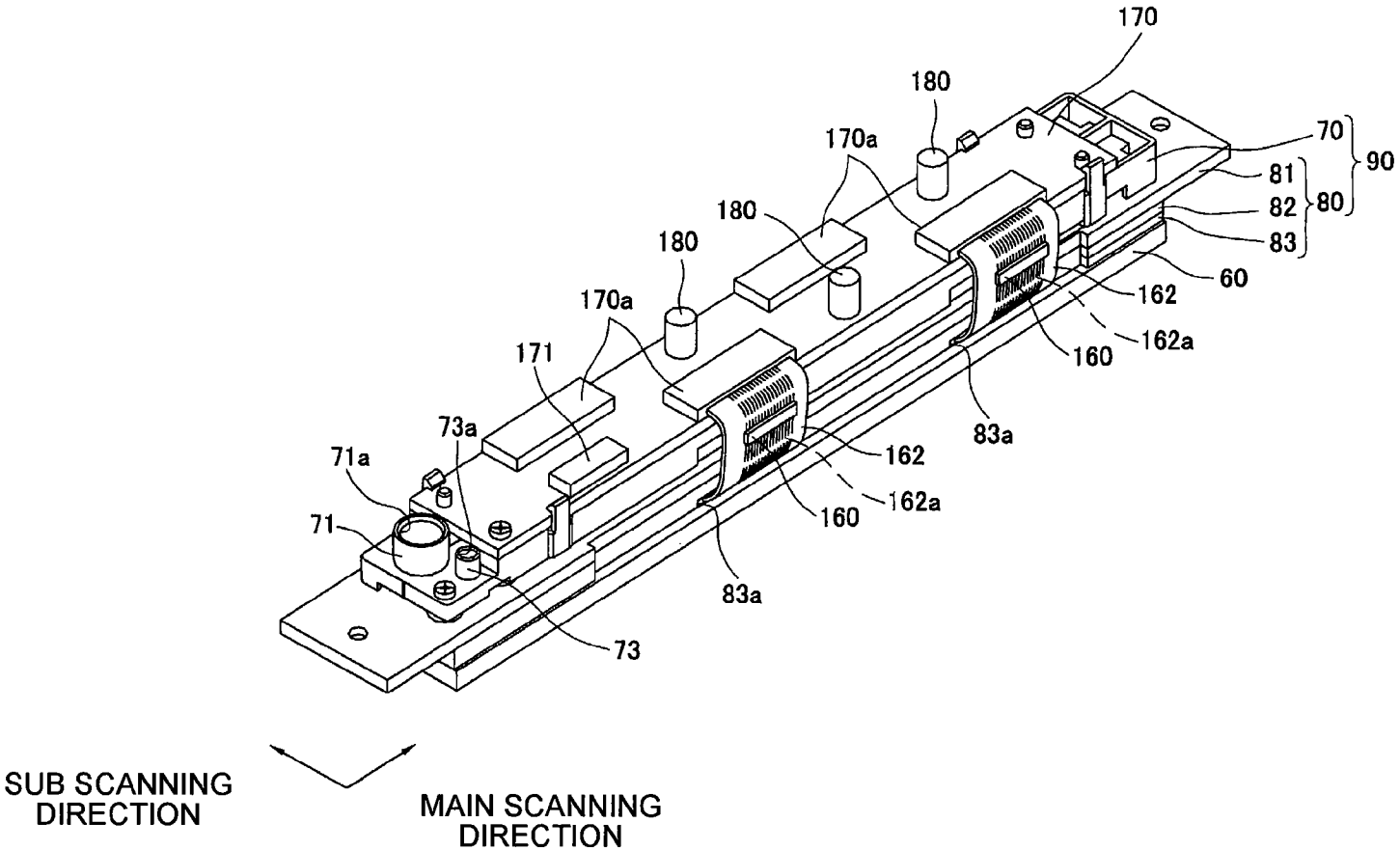
FIG. 2 is a perspective view of the liquid ejection head of FIG. 1, after a head cover and heat sinks are removed from the liquid ejection head.

A structure of an inkjet head included in an inkjet printer according to an embodiment of the invention will be described with reference to FIGS. 1-8, and 10. Inkjet printer 1 may be a line-type color inkjet printer. As shown in FIG. 1, inkjet printer 1 may includes a plurality, e.g., six, inkjet heads 100 for ejecting ink in colors of black (K), cyan (C), magenta (M), yellow (Y), light cyan (LC), and light magenta (LM), respectively. As shown in FIGS. 1 and 2, each inkjet head 100 may have a rectangular parallelepiped shaped line head, whose longitudinal direction is set as a main scanning direction. Each inkjet 100 may include, in order from bottom to top as shown in FIG. 1, a head body 60, a reservoir unit 90, a control circuit board 170, and a head cover 110.

Figure 3:
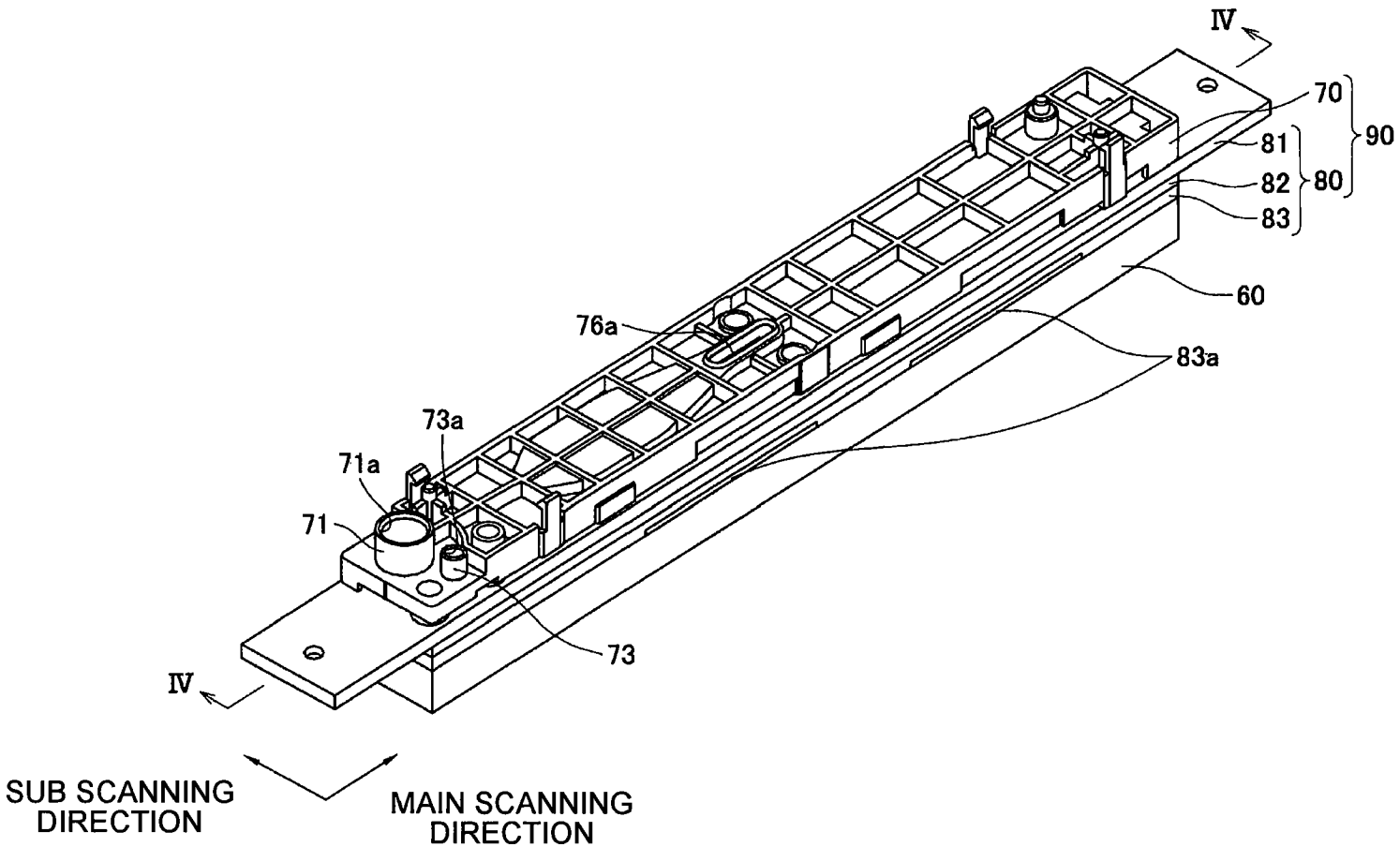
FIG. 3 is a perspective view of the liquid ejection head of FIG. 2, after a control circuit board and a flexible print circuit board are removed from the liquid ejection head.

Reservoir unit 90 may include, in order from bottom to top as shown in FIG. 1, a filter portion 70, and an ink delivery portion 80. In an embodiment, filter portion 70 may comprise a resin, and may be molded of resin in one piece. In another embodiment, ink delivery portion 80 may comprise a metal. Referring to FIGS. 2 and 3, a tubular protrusion 71 may be provided on an upper surface of a longitudinal end of filter portion 70. An ink supply port 71*a* may be formed inside tubular protrusion 71, and an end of an in a supply valve 111 may be attached to tubular protrusion 71, so that ink stored in an ink supply source, e.g., an ink tank, may be supplied from ink supply port 71*a* to inside of filter portion 70, via an ink supply tube (not shown) and ink supply valve 111. A tubular protrusion 73, providing an ink discharge port 73*a*, may be disposed on the same side of inkjet head 100 as ink supply port 71*a*. Referring again to FIG. 1, one end of an ink discharge valve 112 may be attached to tubular protrusion 73, so that ink collected in a waste ink tank (not shown) and in the head may be discharged via ink discharge valve 112 and a discharge tube (not shown).

As shown in FIG. 1, head cover 110 may have a substantially box shape, with an opening downward, and may be disposed on ink delivery portion 80, so as to cover filter portion 70 and control circuit board 170, which may be mounted thereon. Ink supply valve 111 and the other end of ink discharge valve 112 may be exposed on the upper surface of head cover 110. The ink supply tube (not shown) may be inserted into ink supply valve 111, and the ink discharge tube (not shown) may be inserted into ink discharge valve 112.

Sidewalls of head cover 110, with respect a sub scanning direction, e.g., a direction perpendicular to the main scanning direction, as shown in FIGS. 1 and 2, may be formed within rectangular-shaped openings 110*a*. Heat sinks 150 may be exposed from openings 110*a*. Referring to FIG. 2, each beat sink 150 may be disposed in contact with a driver IC 160 mounted on a flexible printed circuit board (FPC) 162. Head cover 110 may include an opening 110*b* at a position corresponding to an input connector 171 on control circuit board 170. Signal lines may be connected to input connector 171 via opening 110*b*.

In inkjet head 100, spaces enclosed by head cover 110, heat sinks 150, ink delivery portion 80, and head body 60 may be hermetically seated, e.g., with a sealing agent (not shown). As shown in FIG. 2, control circuit board 170 may be elongated in the main scanning direction, and may have a substantially rectangular shape. Various electronic devices, e.g., integrated circuit (IC) chips, and capacitors, may be mounted on the upper surface of control circuit board 170, forming a plurality of wiring patterns. These wiring patterns and electronic devices may combine to form processors and a storage device on control circuit board 170. The storage device may be designed to store data, e.g., data for a control program of inkjet head 100, and data for a temporary work. The processors may control operations of the inkjet head 100 based on such data stored in the storage device.

Four connectors 170*a*, an input connector 171, and three electrolytic capacitors 180 may be fixed on the upper surface of control circuit board 170. Four connectors 170*a* may be arranged in two rows in a staggered manner with respect to the main scanning direction. Input connector 171 may be disposed in a vicinity of one end, adjacent to ink supply port 71*a* and ink discharge port 73*a*. Three electrolytic capacitors 180 may be arranged in two rows in a staggered manner offset from four connectors 170*a*. Connectors 170*a*, input connector 171, and electrolytic capacitors 180 may be electrically connected to the processors and the storage device built on the control circuit board.

FPC 162 may be a flexible sheet in which wiring patterns 162*a* may be formed. Driver IC 160 may be mounted on FPC 162 and electrically connected to wiring patterns 162*a*. One end of each FPC 162 may be connected to a side of a corresponding one of connectors 170*a*. The other end of each FPC 162 may be fixed onto an actuator unit 120, pulled upward from opening 83*a* formed in under plate 83 of ink delivery portion 80 along a side of reservoir unit 90, and connected to the corresponding connector 170*a*. Driver IC 160 may drive actuator unit 120, and may be elongated in the main scanning direction and flat in the sub scanning direction. Four connectors 170*a* may be electrically connected to input connector 171 via the wiring on control circuit board 170. Input connector 171 may be connected to a main circuit board (not shown) of printer 1, which may be disposed outside of head cover 110, via the signal lines. Signals transmitted from the main circuit board to input connector 171, e.g., an ejection signal, and a waveform signal, may be transmitted to each connector 170*a*, and then transmitted from connector 170*a* to driver IC 160 on FPC 162, as a drive signal.

Figure 4:
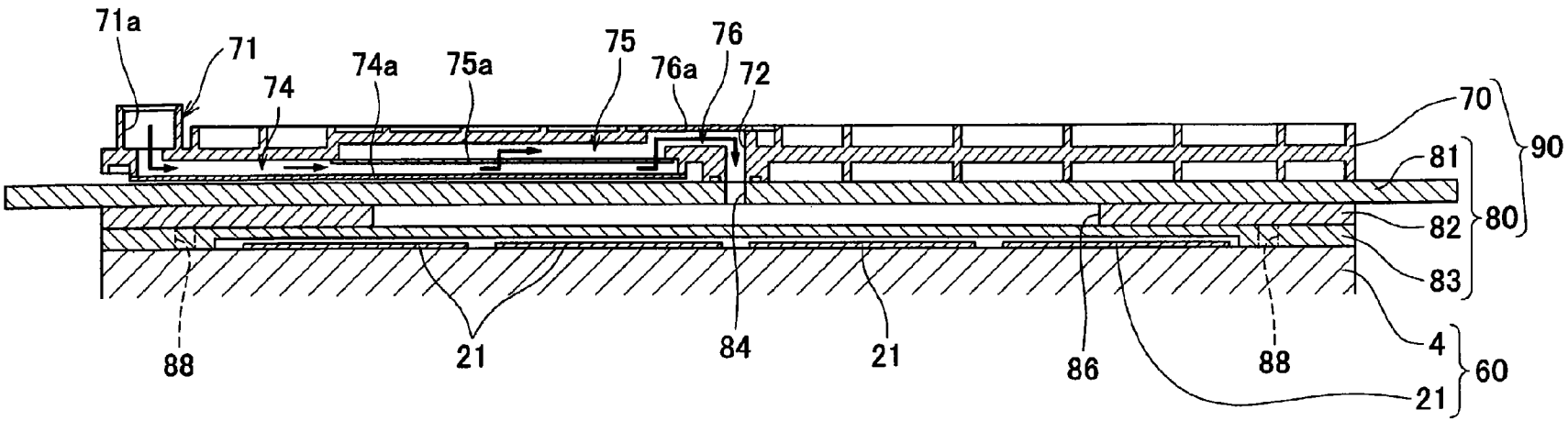
FIG. 4 is a cross-sectional view of the liquid ejection head taken along a line IV-IV of FIG. 3.

Referring to FIG. 4, an ink flow path from ink supply port 71*a* to an outlet port 72 may be formed in filter portion 70. Ink supplied from ink supply port 71*a* may flow in a first hole 74. First hole 74 may be blocked by a damper film 74*a* at a bottom side, so that vibration generated by ink supplied from ink supply port 71*a* may be absorbed by damper film 74*a*. Ink may arrive in first hole 74, and from there ink may flow through a second hole 75. A filter 75*a*, through which ink may pass, may be disposed in second hole 75. After flowing through second hole 75, ink then may pass through a space 76 defined by a damper film 76*a* at an upper portion of filter portion 70, and then may flow downward through outlet port 72, and into ink delivery portion 80.

Figure 5:
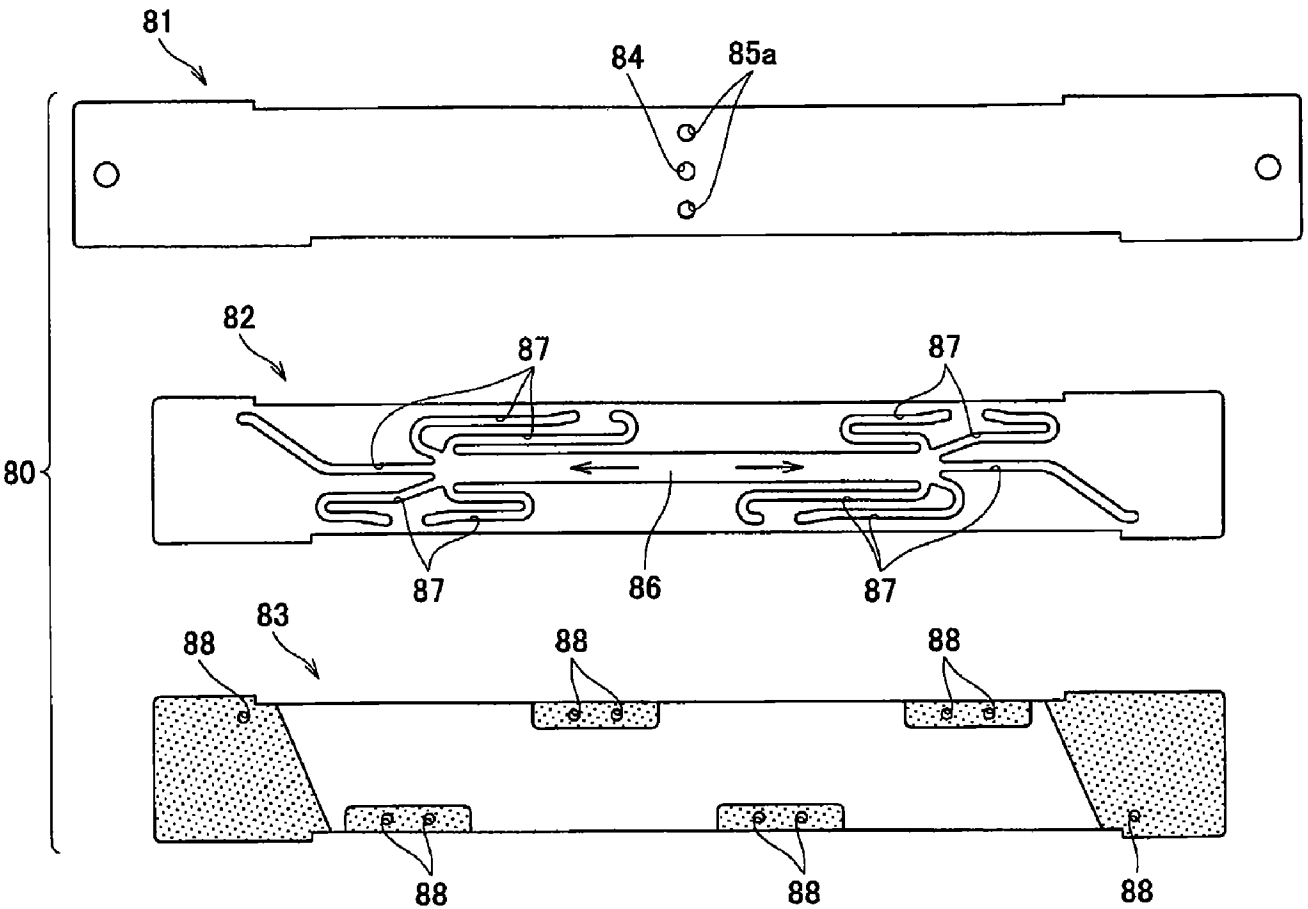
FIG. 5 is a plan view of liquid delivery plates according to an embodiment of the present invention.

FIG. 5 shows constituent elements of ink delivery portion 80 in a view seen from a side of ink delivery portion 80 where the elements are fixed to a flow path unit 4, according to an embodiment of the invention. Ink delivery portion 80 may include an upper plate 81, a reservoir plate 82, and an under plate 83. In an embodiment, upper plate 81, reservoir plate 82, and under plate 23 may be made of metal. Ink delivery portion 80 may be formed by layering and adhesively fixing the three plates 81, 82, 83. Plates 81, 82, 83 may have a substantially rectangular plane shape, elongated in the main scanning direction, and may have substantially the same widths. Upper plate 81 may be slightly longer than reservoir plate 82 and under plate 83, and may be formed with a hole on each end in the longitudinal direction, to mount the head cover 110 and fix head 100 to a holder in printer 1.

An inlet port 84 may be formed in a center of upper plate 81. Ink flowing out from outlet port 72 may then flow into inlet port 84. Screw holes 85 for fastening upper plate 81 to filter portion 70 may be formed on both sides of inlet port 84, in a width direction of upper plate 81. Inlet port 84 and screw holes 85 may pass through upper plate 81 in a thickness direction.

Reservoir plate 82 may be formed with a through hole, shaping a main ink chamber 86 and flow paths 87 branched from main ink chamber 86, so as to deliver ink flowing in from inlet port 84 to through holes 88 formed in under plate 83. Main ink chamber 86 may extend in a longitudinal direction from a part corresponding to inlet port 84 toward both ends of reservoir plate 82. A plurality of, e.g., five, flow paths 87 may be branched from main ink chamber 86 on each side. Ink flowing in the center of main ink chamber 86 from inlet port 84 may be diverged into flow paths 87 on each side. Main ink chamber 86 and flow paths 87 may be formed substantially symmetrically about a center of reservoir plate 82.

Figure 6:
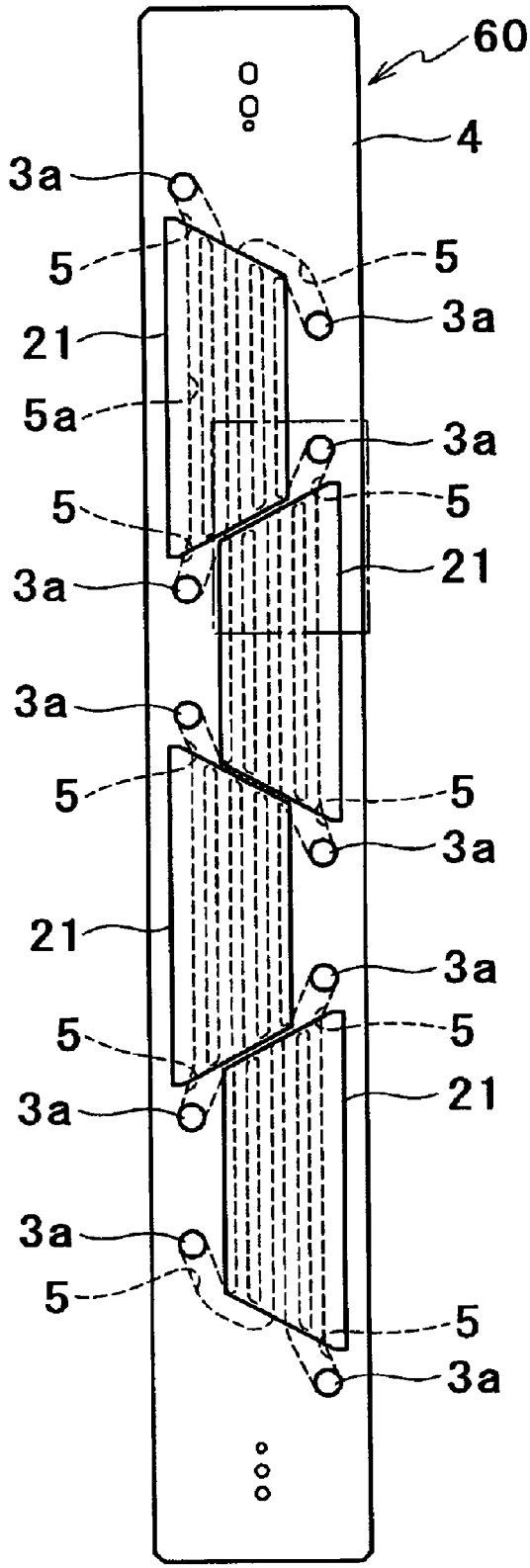
FIG. 6 is a plan view of a head body included in the liquid ejection head according to an embodiment of the present invention.

Under plate 83 may be formed with a plurality of substantially circular through holes 88, at positions which may correspond to tips of flow paths 87, and, referring to FIG. 6, openings 3*a* in flow path unit 4. Referring again to FIG. 5, through holes 88 may be arranged symmetrically with respect to a center of under plate 83. In flowing in holes 88 from the tips of flow paths 87 may be supplied to flow path unit 4 via openings 3*a*. A lower surface of under plate 83 may protrude downward in a portion of under plate 83. In an embodiment, the lower surface of under plate 83 may protrude downward in the areas of under plate 83 which are hatched in FIG. 5. Under plate 83 may be fixed to flow path unit 4 at the hatched areas, and not at the unhatched areas. Areas which are not hatched on the lower surface of under plate 83 may be recessed, e.g., by half etching. The recessed area of under plate 83 may be provided in association with actuator units 21. Referring now to FIGS. 4 and 6, in a gap formed between the recessed area of under plate 83 and flow path unit 4, actuators 21 may be affixed on an upper surface of flow path unit 4.

Figure 8:
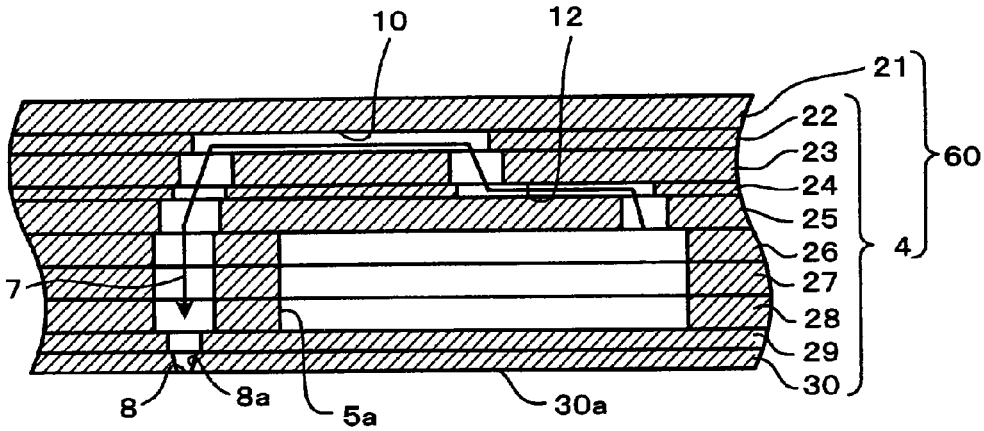
FIG. 8 is a cross-sectional view of the liquid ejection head taken along a line VIII-VIII of FIG. 7.

Referring now to FIG. 8, head body 60 may include flow path unit 4, which may include an ejection surface 30*a* on the lower surface, and four actuator units 21, also shown in FIG. 6, affixed on the upper surface of flow path unit 4. Referring back to FIG. 1, flow path unit 4 may have a substantially rectangular solid shape, elongated in the main scanning direction, and when viewed in a plan view, may have substantially the same size and shape as reservoir unit 90, except for upper plate 81.

Figure 7:
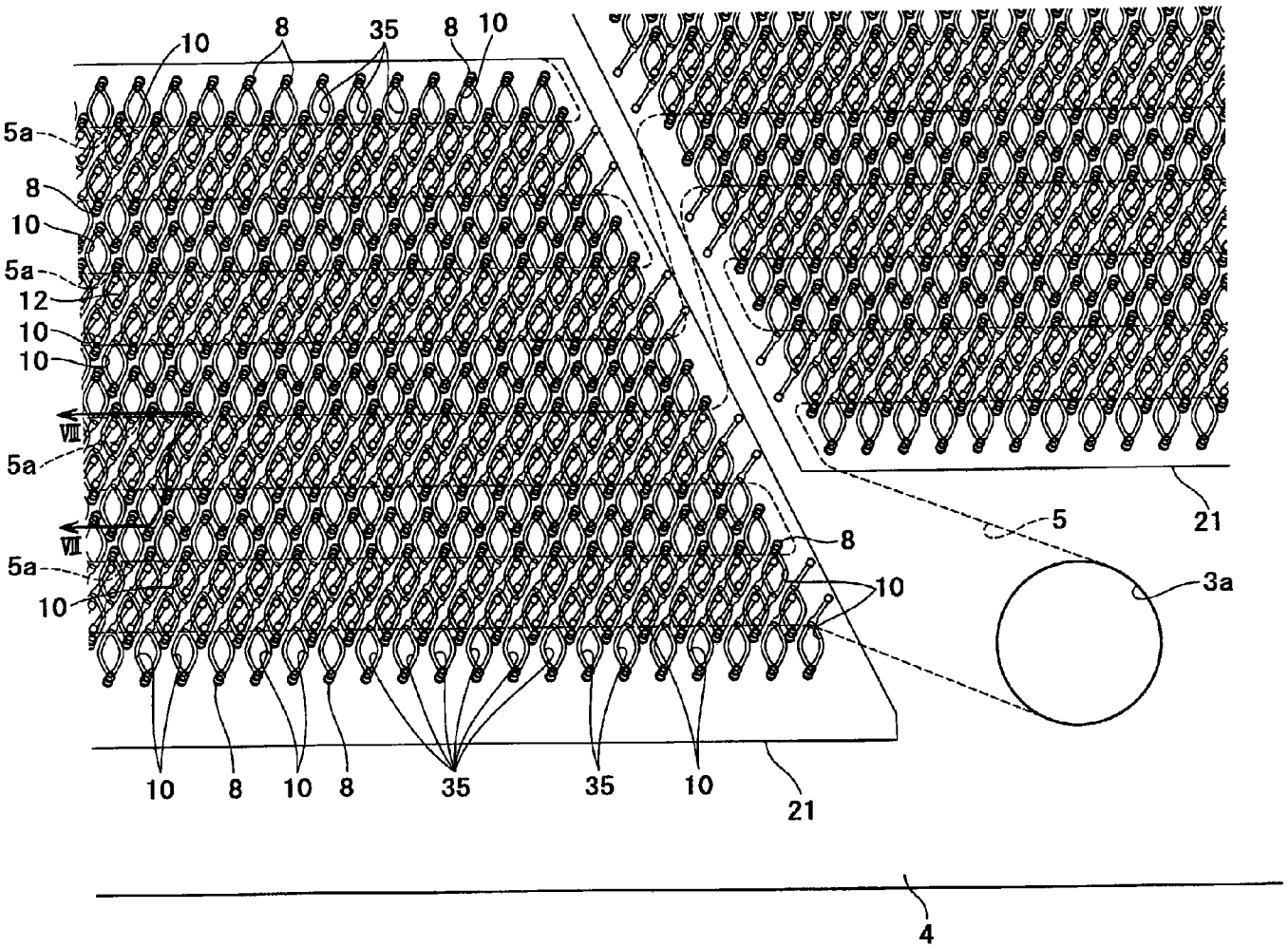
FIG. 7 is an enlarged view of the part of FIG. 6 enclosed with a rectangular dotted line.

FIG. 6 is a plan view of head body 60 showing a surface that may be affixed to reservoir unit 90, e.g., the upper surface of flow unit 4, according to an embodiment of the invention. A plurality of e.g., ten, openings 3*a* may be formed on the upper surface of flow path unit 4, to avoid the actuator units 21. Manifold flow paths 5 may be in fluid communication with openings 3*a*, and may be formed in the flow path unit 4. FIG. 7 is an enlarged view of an area enclosed by the rectangular dotted line in FIG. 6. In FIG. 7, pressure chambers 10, apertures 12, and ejection ports 8 are indicated by solid lines instead of broken lines, in order to simplify the drawings.

As shown in FIG. 7, one manifold flow path 5 may extend along inclined sides of two adjacent actuator units 21. One manifold flow path 5 may be shared between two adjacent actuator units 21, and sub manifold paths 5*a* may branch out from manifold flow path 5, and may extend toward both sides of manifold flow path 5, so as to face actuator units 21. A plurality of, e.g., four sub manifold flow paths 5*a* may extend in the longitudinal direction of flow path unit 4, at an area facing one actuator unit 21. Ink collected in reservoir unit 90 may be supplied via each opening 3*a* to the corresponding manifold flow path 5, and its sub manifold flow paths 5*a*.

As shown in FIGS. 7 and 8, a plurality of ejection ports 8 may be arranged in a matrix pattern in areas corresponding to locations where actuator units 21 may be adhered on ejection surface 30*a*, e.g., the lower surface of flow path unit 4. Ejection ports 8 may be openings of nozzles 8*a* at their tips, and may have a relatively small diameter. Pressure chambers 10 may be arranged in a matrix pattern in areas corresponding to locations where actuator units 21 may be adhered on the upper surface of flow path unit 4. Pressure chambers 10 may be provided in association with the ejection ports 8. Pressure chambers 10 may have a substantially rhombus shape, and may be arranged at spaced intervals in the longitudinal direction of flow path unit 4. In an area where one actuator unit 21 is adhered on the upper surface of flow path unit 4, sixteen columns of pressure chambers 10 may be arranged parallel to each other. Ejection ports 8 may be arranged in a similar manner as pressure chambers 10. Specifically, ejection ports 8 may be arranged at spaced intervals in the longitudinal direction of flow path unit 4 when viewed from a width direction thereof, so that image formation is possible at a high resolution.

As shown in FIG. 8, an individual ink flow path 7 may be formed in flow path unit 4. Individual ink flow path 7 may be provided in association with each ejection port 8, and may connect the sub manifold flow path 5*a*, the aperture 12, the pressure chamber 10, and the ejection port 8 provided at the tip of the nozzle 8*a*. Four actuator units 21 may have a trapezoidal planar shape, and may be arranged in a staggered manner on the upper surface of flow path unit 4, so that two parallel bases of each trapezoid extend in the longitudinal direction of flow path unit 4. As shown in FIG. 4, actuator units 21 may be adhered onto flow path unit 4 with an agent, e.g., an epoxy thermosetting adhesive agent. Actuator units 21 may be adhered onto flow path unit 4 so as to face a bottom wall surface in the recessed portion of the under plate 83, and to form a gap with the bottom wall surface. Referring back to FIG. 5, the recessed portion of under plate 83 may be illustrated as the portion of under plate 83 that is not hatched. The inclined sides of adjacent actuator units 21 may overlap each other in the width direction of flow path unit 4.

Referring again to FIG. 7, individual electrodes 35 may be formed in positions corresponding to pressure chambers 10, on the upper surface of actuator unit 21. Individual electrodes 35 may be smaller than pressure chambers 10. Referring again to FIG. 2, FPCs 162 may be connected to actuator units 21. A potential between each individual electrode 35 and a common electrode (not shown) formed on the entirety of actuator units 21 may be controlled based on a drive signal transmitted from each driver IC 160 via FPCs 162. Areas where individual electrodes 35 are formed on the actuator units 21 may be selectively deformed by this controlling, thereby applying ejection energy to ink in the corresponding pressure chamber 10, and ejecting ink in the pressure chamber 10 from the ejection port 8.

Referring again to FIG. 8, flow path unit 4 may include a plurality of, e.g., nine plates. The plates may include a cavity plate 22, a base plate 23, an aperture plate 24, a supply plate 25, three manifold plates 26, 27, 28, a cover plate 29, and a nozzle plate 30. In an embodiment, the plurality of plates are made of metal, e.g., SUS 430. Flow path unit 4 may be formed by layering and adhesively fixing the plurality of plates.

Cavity plate 22 may be formed with holes having a substantially rhombus shape, corresponding to pressure chambers 10. Base plate 23 may be formed with holes connecting pressure chambers 10 and apertures 12, and holes connecting pressure chambers 10 and nozzles 8*a*. Aperture plate 24 may be formed with holes corresponding to apertures 12, and also with holes connecting apertures 12 and nozzles 8*a*. Supply plate 25 may be formed with holes connecting apertures 12 and sub manifold flow paths 5, and also with holes connecting pressure chambers 10 and nozzles 8*a*. Manifold plates 26, 27, 28 may be formed with sub manifold flow paths 5*a*, and with holes connecting pressure chambers 10 and nozzles 8*a*. Cover plate 29 may be formed with holes connecting pressure chambers 10 and nozzles 8*a*. Nozzle plate 30 may be formed with nozzles 8*a*.

Plates 22 to 30 may be layered in position to form individual ink flow paths 7. Each individual ink flow path 7 may define a path moving upward from the outlet of sub manifold flow path 5*a*, extending horizontally at aperture 12, moving further upward, again extending horizontally at pressure chamber 10, and moving downward to nozzle 8*a*.

As shown in FIG. 8, pressure chamber 10 may be disposed at a different level from aperture 12, with respect to a direction where nine plates 22 to 30 are layered. Referring again to FIG. 7, aperture 12 in fluid communication with one pressure chamber 10 may be disposed to overlap an adjacent pressure chamber 10, when viewed in a plan view. As a result, pressure chambers 10 may be disposed at a high density, facilitating size reduction of inkjet head 100, and high-resolution printing.

Figure 9:
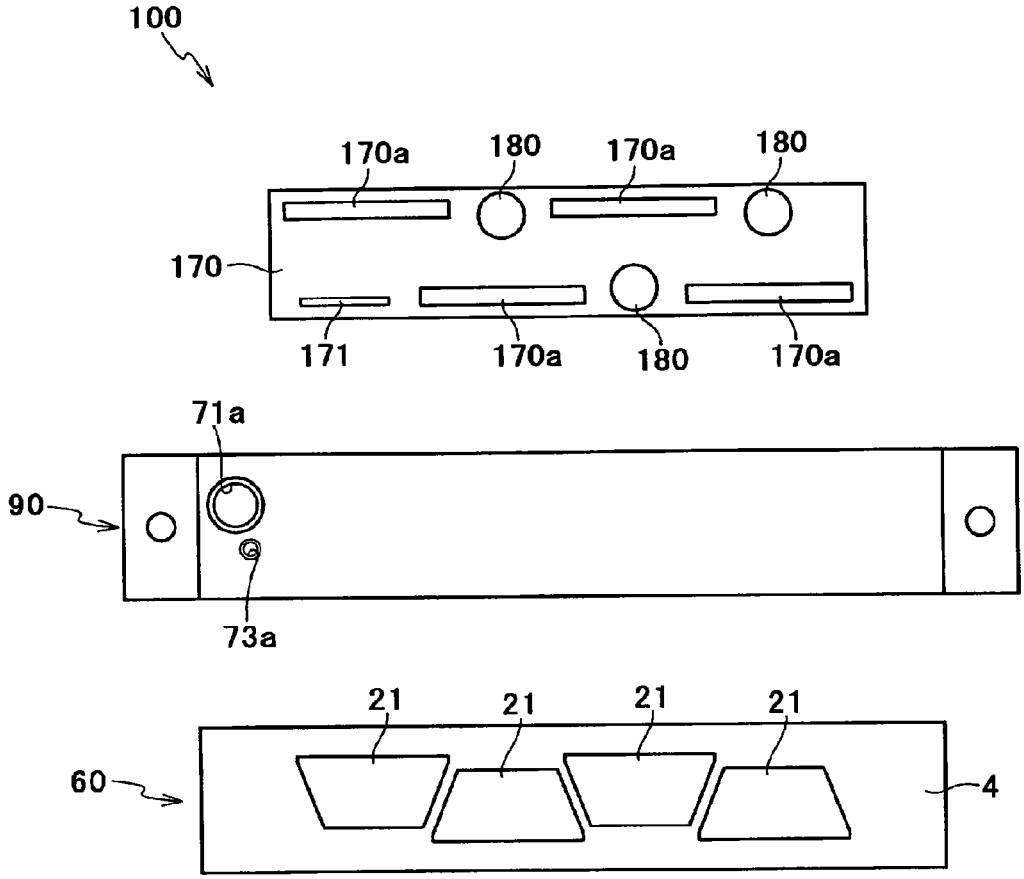
FIG. 9 is a plan view showing a control circuit board, a reservoir unit, and a head body included in a liquid ejection head according to an embodiment of the present invention.
Figure 10:
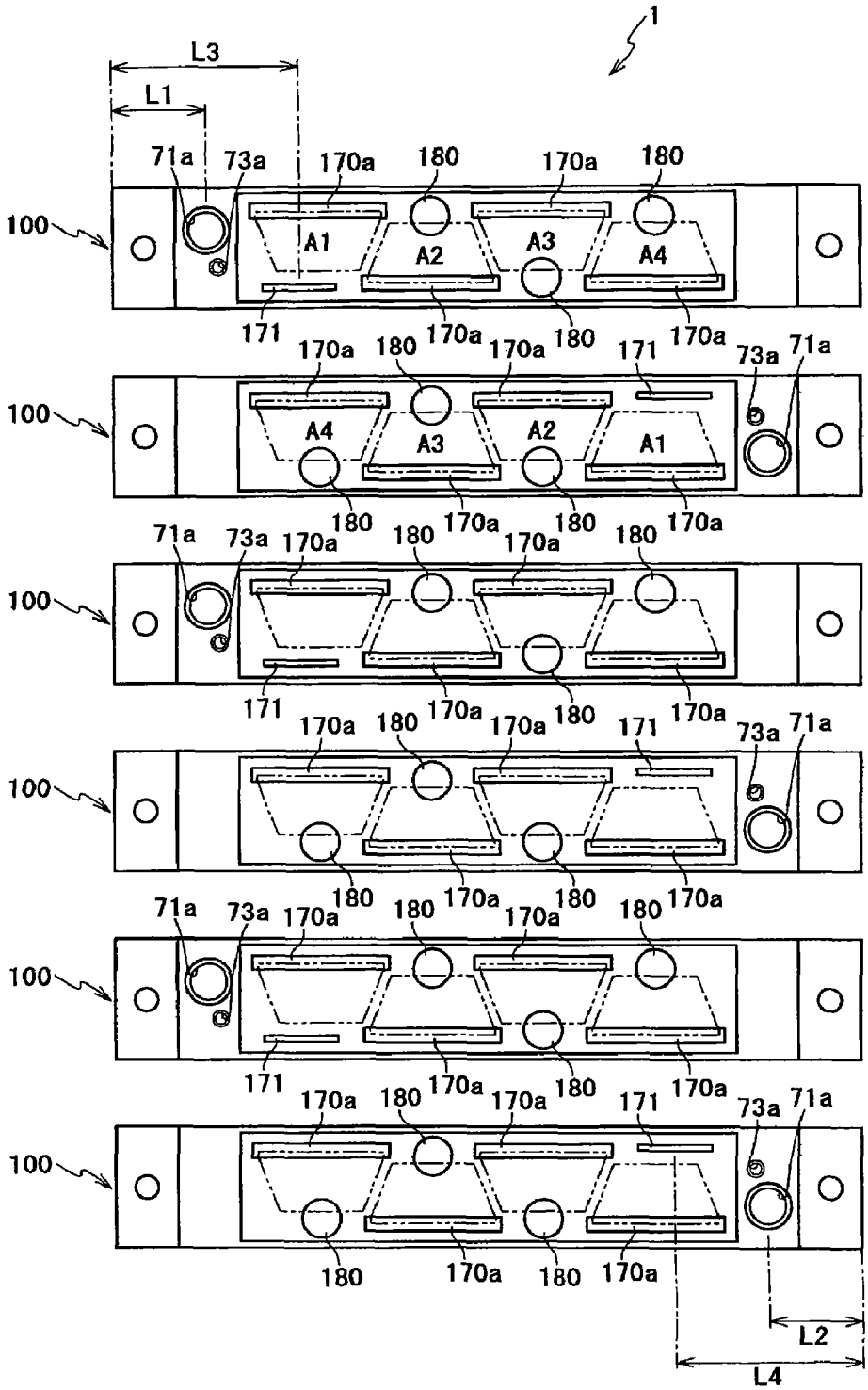
FIG. 10 is a plan view of liquid ejection heads according to an embodiment of the present invention

FIGS. 9 and 10 describe the structure of ink-jet head 100 and an array of inkjet heads 100 in printer 1. FIG. 9 is a plan view showing control circuit board 170, reservoir unit 90 and head body 60 in one inkjet head 100, according to an embodiment of the invention. FIG. 10 is a plan view of six inkjet heads 100 disposed in printer 1, and each ink-jet head 100 may be formed by layering the elements shown in FIG. 9.

As shown in FIG. 10, a plurality of, e.g., six, inkjet heads 100 may be disposed parallel to each other in the width direction in inkjet printer 1. Inkjet heads 100 may all be constructed in the same manner. In the embodiment illustrated in FIG. 10, starting with the first inkjet head 100 from the top, in alternating inkjet heads 100, inkjet head 100 may be positioned so that ink supply port 71*a*, ink discharge port 73*a*, and input connector 171 are disposed on the left side of inkjet bead 100, when positioned as shown in FIG. 10. Similarly, starting with the second inkjet bead 100 from the top, in alternating inkjet heads 100, inkjet head 100 may be positioned so that ink supply port 71*a*, ink discharge port 73*a*, and input connector 171 are disposed on the right side of inkjet head 100, when positioned as shown in FIG. 10.

Thus, ink supply ports 71*a* of any two adjacent inkjet heads 100 may have different positions in the longitudinal direction, so that ink supply ports 71*a* may be arranged in a staggered manner as a whole. Ink discharge ports 73*a* and input connectors 171, which may be disposed in the vicinity of ink supply ports 71*a*, also may be arranged in a staggered manner. In two adjacent inkjet heads 100, because the adjacent inkjet heads 100 are positioned with the ink supply port 71*a*, ink discharge port 73*a*, and input connectors 171 on opposite ends, the actuator units in one inkjet head 100 may be disposed differently from those in the adjacent inkjet head 100. Specifically, in FIG. 10, actuator units A1, A2, A3, and A4 in the top inkjet head 100 may be disposed differently from those in the second inkjet head 100.

Input connectors 171 also may be arranged in a staggered manner. If ejection ports 8 in ejection surface 30*a* are arranged symmetrically, ejection signals supplied to input connectors 171 may be converted by replacing an ejection amount and ejection timing at each ejecting position indicated in data, with those for each ejection port 8 arranged symmetrically with respect to a center of head 100. If the ejection ports 8 in the ejection surface 30*a* are not arranged symmetrically with respect to the center of the head 100, a more complicated adjustment of ejection timing may be required.

As described above, in an embodiment of inkjet printer 1, the positions of ink supply ports 71*a* of inkjet heads 100 adjacently disposed with respect to the width direction, are different from each other in the longitudinal direction. In comparison to a case in which inkjet beads 100 are disposed with ink supply ports 71*a*, ink discharge points 73*a*, and input connectors 71 disposed on the same side of adjacent inkjet heads, the arrangement of inkjet heads 100 of an embodiment of the invention may provide a wide working space, thereby facilitating attachment of tubes to ink supply ports 71*a*.

As shown in FIG. 10, a distance L1 indicates a longitudinal distance from a center of ink supply port 71*a* to one end thereof, formed in the odd-numbered inkjet head 100, e.g., the inkjet head 100 having ink supply port 71*a* on the left hand side when inkjet printer 1 is positioned as shown in FIG. 10. A distance L2 indicates a longitudinal distance from a center of ink supply port 71*a* to an end thereof formed in even-numbered inkjet head 100, e.g., the inkjet head 100 having ink supply port 71*a* on the right hand side when inkjet printer 1 is positioned as shown in FIG. 10. The end measured in the odd-numbered inkjet heads 100 is opposite the end measured in the even-numbered inkjet heads 100, and distance L1 and distance L2 may be equal. Thus, ink supply ports 71*a* of inkjet heads 100 may be disposed in two different positions in the longitudinal direction, which may facilitate attachment of tubes to ink supply ports 71*a*, and may reduce the complexity of operation caused by an increase in number of positions of the ink supply ports 71*a*.

Regarding any two inkjet heads 100 adjacently disposed in the width direction, the positions of input connectors 171 may be different in the longitudinal direction. Thus, working space may be widened, and connection of the signal lines to input connectors 171 may be simplified.

As shown in FIG. 10, a distance L3 may indicate a longitudinal distance from a center of input connector 171 to one end thereof, in odd-numbered inkjet head 100. A distance L4 may indicate a longitudinal distance from a center of input connector 171 to one end thereof in even-numbered inkjet bead 100, which is an opposite end from the end measured in odd-numbered inkjet head 100, and distance L3 and distance LA may be equal. Thus, input connectors 171 of inkjet heads 100 may be disposed in two different positions in the longitudinal direction, which may facilitate connection of the signal lines to input connectors 171, and may prevent the complexity of operation caused by an increase in the number of positions of input connectors 171.

As described above, inkjet heads 100 included in inkjet printer 1 may be identical in structure. Thus, inkjet printer 1 may have a desired configuration by using inkjet heads 100 of the same structure.

Even when the heads 100 are disposed as described above, ejection ports 8 may be disposed point-symmetrically with respect to the center of ejection surface 30*a*. Thus, the positions of ejection ports 8 may not shift in the width direction. a Thus, a conversion process of the ejection signals resulting from a ejection ports 8 being shifted in the width direction may be simplified or eliminated.

A center of an arrangement of ejection ports 8 in ejection surface 30*a* may be the center of the plane formed by inkjet bead 100, and aligns with an axis of symmetrical rotation of inkjet head 100. Even when ejection ports 8 are arranged point-symmetrically in ejection surface 30*a*, if the axis of symmetrical rotation of inkjet head 100 does not align with the center of the arrangement of ejection ports 8 in ejection surface 30*a*, inkjet bead 100 should be reinstalled in inkjet printer 1, so as to adjust the center of the arrangement of ejection ports 8. However, when the axis of symmetrical rotation of inkjet head 100 is aligned with the center of the arrangement of ejection ports 8, as in an embodiment shown in FIG. 10, there is no need to reinstall the head 100 in the printer 1. Each head 100 may include ink discharge port 73*a*, disposed on the same side of inkjet 100 as ink supply ports 71*a*, thereby facilitating attachment of the tubes to ink discharge port 73*a*, as well as to ink supply port 71*a*.

Figure 11:
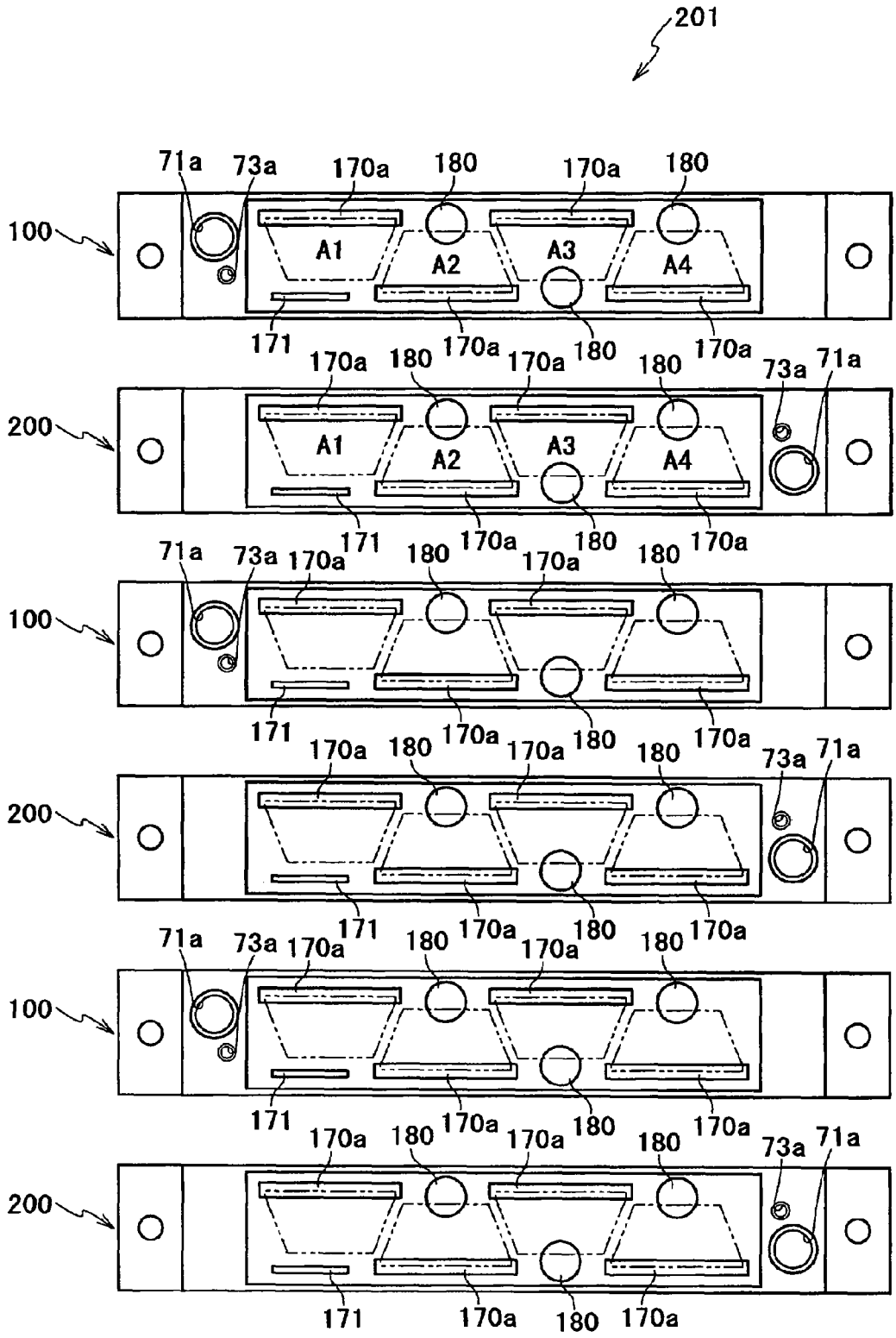
FIG. 11 is a plan view of liquid ejection heads according to another embodiment of the present invention.

FIG. 11 describes an inkjet printer 201 according to another embodiment of the invention. Parts substantially equivalent to those described above are denoted by the same reference numerals, and descriptions thereof will be omitted. In inkjet printer 201, inkjet heads 100 and inkjet heads 200 may be alternately disposed along a width direction. Each inkjet head 200 includes the same parts 170, 90, 60 as inkjet head 100 includes, as shown in FIG. 9, however, reservoir unit 90, formed with ink supply port 71*a* and ink discharge port 73*a*, may be rotated 180 degrees. In other words, inkjet head 200 may be modified from the inkjet head 100 by maintaining control circuit board 170 and head body 60 in the same position as in inkjet head 100, and rotating reservoir unit 90 180 degrees around an axis located at a center of inkjet head 100 and extending in the thickness direction of inkjet head 100, e.g., a direction perpendicular to the sheet of FIG. 11 when inkjet printer 1 is positioned as shown in FIG. 11.

As described above, in inkjet head 200, control circuit board 170 and head body 60 are not rotated. Thus, the positions of input connector 171 and actuator units 21 may be substantially the same in both inkjet heads 100 and 200. For example, when inkjet printer 1 is positioned as shown in FIG. 11, input connectors 171 may be disposed on the left side and actuator units A1, A2, A3, A4 may be disposed on the same positions in both top head 100 and second head 200.

According to the above embodiment, two reservoir units 90 included in two inkjet heads 100, 200 adjacently disposed in the width direction, may be disposed as if one reservoir unit 90 were rotated 180 degrees around an axis of symmetrical rotation. In this case, input connector 171 on control circuit board 170 may be held in the same position, e.g., on the left side of the inkjet heads 100, 200, when inkjet printer 1 is positioned as shown in FIG. 11, in any inkjet head 100, 200. Thus, a conversion process of ejection signals resulting from a staggered arrangement of the input connectors 171 (FIG. 10) may be simplified or eliminated. Further, even if ejection ports 8 on ejection surface 30*a* of each inkjet head 100, 200 may not be disposed point-symmetrically, the positions of ejection ports 8 are not changed. Thus, a conversion process of the ejection signals resulting from ejection ports 8 changing position may be simplified or eliminated.

A center of the arrangement of through holes 88 and openings 3*a* provided between reservoir unit 90 and flow path unit 4 may be the center of inkjet heads 100, 200, and may be aligned with the axis of symmetrical rotation. Even when the axis of symmetrical rotation may not agree with the center of the arrangement of through holes 88 and openings 3*a*, connection of the reservoir unit 90 and the flow path unit 4 may be accomplished according to sizes of through holes 88 and openings 3*a*. Nevertheless, when the axis of symmetrical rotation agrees with the center of the arrangement of through holes 88 and openings 3*a*, the connection of reservoir unit 90 and flow path unit 4 may become more favorable, which may result in lower flow resistance, and ink may flow smoothly from reservoir unit 90 to flow path unit 4.

Figure 12:
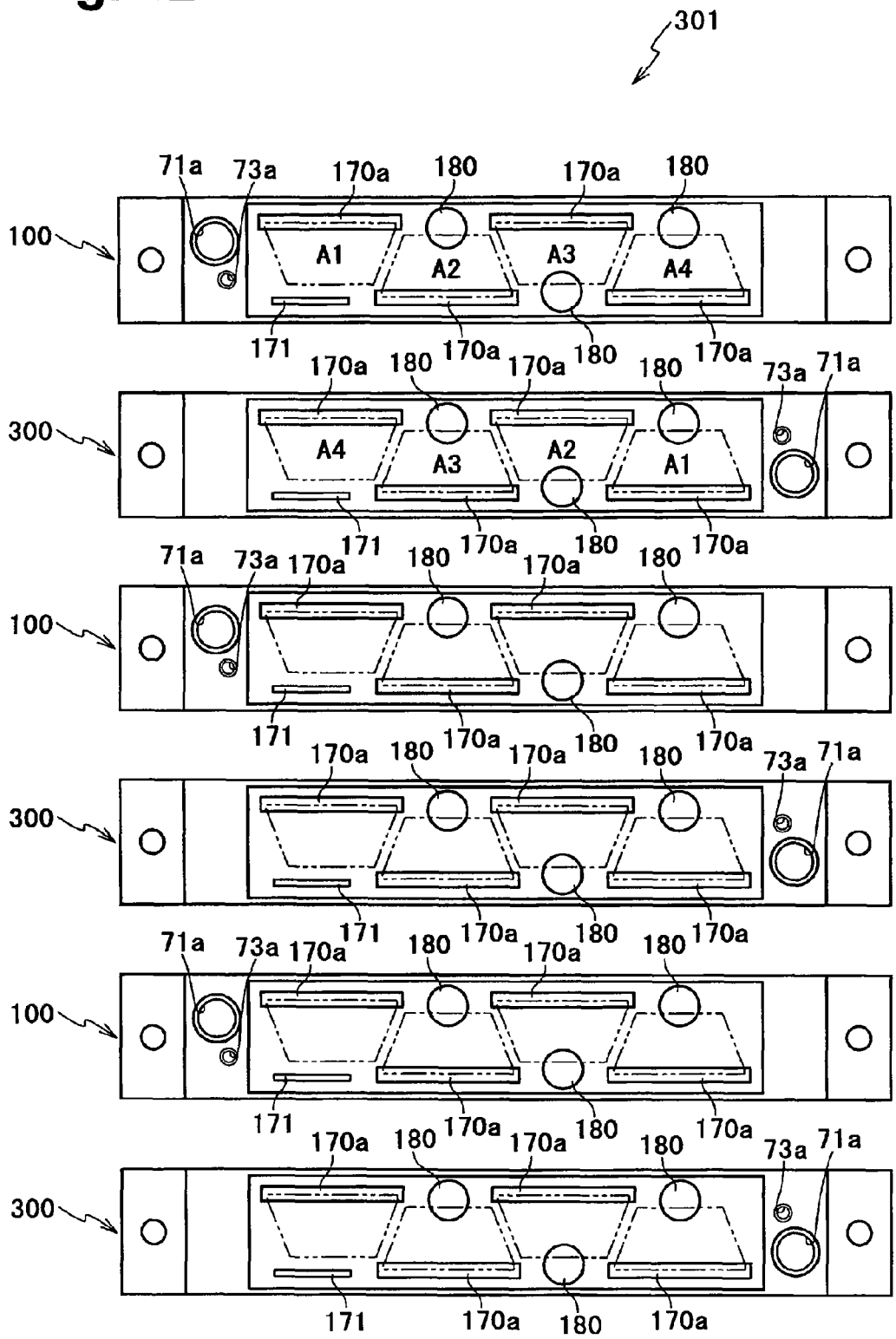
FIG. 12 is a plan view of liquid ejection heads according to still another embodiment of the present invention.

FIG. 12 shows a plan view of an inkjet printer 301 according to a yet another embodiment of the invention. Parts substantially equivalent to those described above are denoted by the same reference numerals, and descriptions thereof will be omitted. In inkjet printer 301, inkjet heads 100 and inkjet heads 300 may be disposed alternately along the width direction. Each inkjet head 300 includes the same parts 170, 90, 60 as the inkjet head 100, as shown in FIG. 9, but the reservoir unit 90 and the head body 60 (hereinafter referred to as a flow path body collectively) are rotated 180 degrees around an axis of symmetrical rotation Inkjet bead 300 is modified from inkjet head 100 by rotating the flow path body 180 degrees around an axis of symmetrical rotation located at a center of head 100, and extending in the thickness direction of head 100 e.g., a direction perpendicular to the sheet of FIG. 12 when inkjet printer 1 is positioned as shown in FIG. 12.

As control circuit board 170 may not be rotated in inkjet head 300, the positions of input connectors 171 may be unchanged between inkjet heads 100 and 300. For example, in the top inkjet head 100 and the second inkjet head 300 of FIG. 12, the input connectors 171 are disposed on the left side when inkjet printer 1 is positioned as shown in FIG. 12. As head body 60 may be rotated 180 degrees in inkjet head 300, the positions of actuator units A1, A2, A3, A4 in inkjet bead 300 may be different than their positions in inkjet heads 100. For example, in the top inkjet head 100, and the second inkjet head 300 of FIG. 12, the positions of actuator units A1, A2, A3, A4 may be different.

According to the modification, two flow path bodies included in two inkjet heads 100, 300 adjacently disposed in the width direction may be disposed as if one reservoir unit 90 were rotated 180 degrees around a symmetrical axis of rotation. Input connector 171 on control circuit board 170 may be held in the same position in inkjet heads 100 and 300. Thus, a conversion process of ejection signals resulting from a staggered arrangement of the input connectors 171 (FIG. 10) may be simplified or eliminated.

When the flow path body is rotated 180 degrees, the ejection ports 8 may be disposed in ejection surface 30*a* point-symmetrically with respect to the center of the plane, and a conversion process of ejection signals resulting from that the ejection ports 8 are shifted in the width direction ma be simplified or eliminated. [0065] The center of the arrangement of ejection ports 8 in ejection surface 30*a* may be the center of the plane formed by inkjet head 100, and may align with the axis of symmetrical rotation. Even when ejection ports 8 may be disposed in ejection surface 30*a* point-symmetrically, if the axis of symmetrical rotation and the center of arrangement of ejection ports 8 do not align, the positions of inkjet heads 100, 300 may be changed to adjust the positions of ejection ports 8 in each inkjet head 100, 300. However, when the axis of symmetrical rotation and the center of the arrangement of ejection ports 8 align, there may be no need to adjust the positions of inkjet heads 100, 300 in inkjet printer 1. In the above embodiment, each inkjet head 100, 300 may be provided with ink discharge port 73*a* and ink supply port 71*a*. However, if a valve capable of switching between ink supply and ink discharge may be attached to ink supply port 71*a*, ink discharge port 73*a* may not be provided.

The center of the arrangement of ejection ports 8 on ejection surface 30*a* may align with the axis of symmetrical rotation. Nevertheless, if the center of the arrangement of ejection ports 8 on ejection surface 30 a does not align with the axis of symmetrical rotation, e.g., if all inkjet heads 100, 300 and flow path bodies are rotated 180 degrees about the axis of symmetrical rotation, the positions of inkjet heads 100, 300 may be changed to adjust the positions of ejection ports 8 in each inkjet head 100, 300.

Ejection ports 8 may be arranged on ejection surface 30*a* point-symmetrically with respect to the center of the plane formed by ejection surface 30*a*. Nevertheless, if ejection ports 8 are not arranged on ejection surface 30*a* point-symmetrically with respect to the center of the plane formed by ejection surface 30*a*, e.g., if all inkjet heads 100, 300 and flow path bodies are rotated 180 degrees, the positions of ejection ports 8 may be shifted in the width direction, and a conversion process may be performed on the ejection signals.

In still another embodiment, an upper portion of the flow path body, made up of reservoir unit 90 and head body 60, including supply port 71*a* disposed above a boundary in the flow path body, may be rotated as an upper flow path body. Supply port 71*a* may be rotated with reservoir unit 90 and head body 60 because flow paths formed in each element of reservoir unit 90 may be symmetric with respect to the axis of rotation. Thus, even if filter portion 70 of reservoir unit 90 is rotated as an upper flow path body, and the other portions, e.g., ink delivery portion 80, and flow path unit 4, which may be disposed under reservoir unit 90, are maintained in their position, e.g., not rotated, as a lower flow path body, fluid communication between outlet port 72 of filter portion 70 and inlet port 84 of upper plate 81 may be maintained. If elements disposed above reservoir plate 82 of reservoir unit 90 may be rotated as an upper flow path body, and under plate 83 and flow path unit 4, which may be disposed under reservoir plate 82, are maintained in their position, e.g., not rotated, as a lower flow path body, fluid communication between each of the plurality of, e.g. ten, through holes 88 of under plate 83 and a corresponding one of the plurality of, e.g., ten, flow paths 87 of reservoir plate 82 may be maintained in their position.

Thus, as long as flow paths formed in reservoir unit 90 are symmetric with respect to the axis of symmetrical rotation, a boundary may be provided in reservoir unit 90 or at a position where reservoir unit 90 meets an upper portion of the flow path body. The portion of reservoir unit 90 that may be disposed above the boundary may be rotated. In addition, a center of an arrangement of connection ports that may connect the upper flow path body and the lower flow path body in a boundary therebetween, may not align with the axis of symmetrical rotation. In this case, however, the center of the arrangement of the connection ports and the axis of symmetrical rotation may be disposed at a position where an amount of ink flows in the connection ports.

In another embodiment, regarding any two heads disposed adjacently in the width direction, any arrangement of head body 60, reservoir unit 90, and control circuit board 170 may be possible, if the positions of ink supply ports 71*a* in the adjacent inkjet heads are different in the longitudinal direction. For example, referring again to FIG. 10, distance L1 of the odd-numbered inkjet head 100 may not be equal to distance L2 of the even-numbered inkjet head 100. In yet another embodiment, regarding any two heads disposed adjacently in the width direction, any arrangement of head body 60, reservoir unit 90, and control circuit board 170 may be possible, if the positions of input connectors 171 in the adjacent inkjet heads are different in the longitudinal direction. For example, referring again to FIG. 10, distance L3 of the odd-numbered inkjet head 100 may not be equal to distance L4 of the even-numbered inkjet head 100. Further in still another embodiment, input connectors 171 may be omitted.

Printers 1, 201, 301 are not limited to color inkjet printers, but may include any device which ejects liquid. Although FIGS. 10, 11, and 12 illustrate inkjet printers 1, 201, 301 having six heads, the number of heads included in inkjet printers 1, 201, 301 is not limited to six. In another embodiment inkjet printers 1, 201, 301 may include any number of inkjet heads greater than one, e.g., two or more.

Printers 1, 201, 301 also are not limited to line-type inkjet printers, but also may be any other device having heads configured to eject liquid, e.g., serial-type inkjet printers, facsimile machines, copiers, and machinery for manufacturing devices that use liquid displays, e.g., LCD screens. Further, the inkjet heads are not limited to ejecting ink but may eject any other liquid.

Although the embodiment of the present invention has been described in detail herein, the scope of the invention is not limited thereto. It will be appreciated by those skilled in the art that various modifications may be made without departing from the scope of the invention. Accordingly, the embodiments disclosed herein we only exemplary. It is to be understood that the scope of the invention is not to be limited thereby, but is to be determined by the claims which follow.

What is claimed is:

1. A liquid ejection apparatus comprising:

a plurality of liquid ejection heads extending in a particular direction, each of the plurality of liquid ejection heads comprising:

an ejection surface comprising a plurality of ejection ports configured to eject a liquid;

a supply port to which the liquid is supplied; and a flow path formed in the liquid ejection head, the flow path configured to place the plurality of ejection ports and the supply port in fluid communication, wherein the plurality of liquid ejection heads are positioned at predetermined intervals in a further direction, the further direction being substantially perpendicular to the particular direction, and wherein, for each of the plurality of liquid ejection heads, the supply port of one of the plurality of liquid ejection heads is positioned in a different location in the particular direction than all of the liquid ejection heads positioned adjacent to the one liquid ejection head in the further direction.

2. The liquid ejection apparatus according to claim 1, wherein a distance from a center of the supply port formed in an odd-numbered liquid ejection head of the plurality of liquid ejection heads, to an end of the odd-numbered liquid ejection head in the particular direction, is equal to a distance from a center of the supply port formed in an even-numbered liquid ejection head of the plurality of liquid ejection heads, to an end of the even-numbered liquid ejection head in the particular direction.

3. The liquid ejection apparatus according to claim 2, wherein the plurality of liquid ejection heads have identical structures, and any two liquid ejection heads adjacently positioned in the father direction are oriented so that one of the liquid ejection heads has been rotated 180 degrees when compared to the other of the liquid ejection heads, around an axis of rotation substantially at the center of the liquid ejection head, and substantially perpendicular to the ejection surface.

4. The liquid ejection apparatus according to claim 3, wherein the ejection ports are arranged symmetrically with respect to a point on the ejection surface in each of the plurality of liquid ejection heads.

5. The liquid ejection apparatus according to claim 4, wherein a center of an arrangement of the ejection ports on the ejection surface is aligned with the axis of rotation.

6. The liquid ejection apparatus according to claim 1, wherein each of the plurality of liquid ejection heads further comprises a connector connected to a signal line, wherein the signal line and connector are configured to supply a signal to the liquid ejection head, and wherein the connector is positioned in the liquid ejection head in a different location in the particular direction than all of the liquid ejection heads positioned adjacent to the liquid ejection head in the further direction.

7. The liquid ejection apparatus according to claim 6, wherein a distance from a center of the input connector positioned in an odd-numbered liquid ejection head of the plurality of liquid ejection heads, to an end of the odd-numbered liquid ejection head in the particular direction, is equal to a distance from a center of the input connector positioned in an even-numbered liquid ejection head to an end of the even-numbered liquid ejection head in the particular direction.

8. The liquid ejection apparatus according to claim 7, wherein each of the plurality of liquid ejection heads further comprises:

a circuit board attached to the connector; and a flow path body comprising a lower flow path body and an upper flow path body, wherein the lower flow path body comprises a particular portion configured to be in fluid communication with the ejection ports, the upper flow path body comprises a further portion configured to be in fluid communication with the supply port, and a boundary between the lower flow path body and the upper flow path body includes one or more connection ports arranged point-symmetrically and configured to connect the lower flow path body and the upper flow path body.

9. The liquid ejection apparatus according to claim 8, wherein any two upper flow path bodies included in two liquid ejection heads adjacently positioned in the further direction, are oriented so that one upper flow path body has been rotated 180 degrees when compared to the other upper flow path body, around an axis of rotation substantially at the center of the liquid ejection head, and substantially perpendicular to the ejection surface.

10. The liquid ejection apparatus according to claim 9, wherein a center of an arrangement of the connection ports in the boundary is aligned with the axis of rotation.

11. The liquid ejection apparatus according to claim 8, wherein a center of an arrangement of the connection ports in the boundary is aligned with the axis of rotation.

12. The liquid ejection apparatus according to claim 7, wherein each of the plurality of liquid ejection heads comprises:

a flow path body comprising the ejection surface, the supply port, and the flow path; and a circuit board attached to the connector, wherein any two flow paths included in two liquid ejection heads adjacently positioned in the further direction, are oriented so that one flow path has been rotated 180 degrees when compared to the other flow path, around an axis of rotation substantially at the center of the liquid ejection head, and substantially perpendicular to the ejection surface.

13. The liquid ejection apparatus according to claim 1, wherein each of the plurality of liquid ejection heads further comprises a discharge port configured to discharge a liquid on a side of the liquid ejection heads where the supply port is located.

14. The liquid ejection apparatus according to claim 1, wherein the liquid ejection apparatus is an inkjet printer.

15. The liquid ejection apparatus according to claim 1, wherein the liquid ejected by the ejection ports is ink.

* * * * *